US006413929B1

(12) United States Patent
Wehlage et al.

(10) Patent No.: US 6,413,929 B1
(45) Date of Patent: Jul. 2, 2002

(54) BLEACHING EFFICIENCY BOOSTERS FOR BLEACH AND TEXTILE DETERGENT COMPOSITIONS

(75) Inventors: Thomas Wehlage, Speyer; Dieter Boeckh, Limburgerhof; Werner Bertleff, Viernheim; Alfred Oftring, Bad Dürkheim, all of (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 09/619,691

(22) Filed: Jul. 19, 2000

Related U.S. Application Data

(62) Division of application No. 09/155,354, filed as application No. PCT/EP97/01513 on Mar. 25, 1997, now Pat. No. 6,130,198.

(30) Foreign Application Priority Data

Mar. 26, 1996 (DE) ..... 196 11 992
Jun. 27, 1996 (DE) ..... 196 25 908

(51) Int. Cl.[7] ..... C11D 3/30; C11D 3/395

(52) U.S. Cl. ..... 510/500; 510/276; 510/286; 510/302; 510/312; 510/313; 510/314; 510/332; 510/367; 510/376; 510/499

(58) Field of Search ..... 510/276, 286, 510/302, 312, 313, 314, 332, 367, 376, 499, 500

(56) References Cited

U.S. PATENT DOCUMENTS

| | | | |
|---|---|---|---|
| 3,751,222 A | | 8/1973 | Gobert |
| 4,648,979 A | * | 3/1987 | Parslow et al. |

FOREIGN PATENT DOCUMENTS

| | | | |
|---|---|---|---|
| CH | 676 410 | | 1/1991 |
| DE | 23 01 235 | | 7/1974 |
| DE | 129 656 | | 1/1977 |
| EP | 0 173 398 | | 3/1986 |
| EP | 0 236 270 | | 9/1987 |
| EP | 173398 | * | 3/1988 |
| EP | 315204 | * | 5/1989 |
| EP | 0 349 153 | | 1/1990 |
| EP | 0 026 529 | | 8/1992 |
| JP | 06 248 295 | | 9/1994 |
| JP | A 07 197 097 | | 8/1995 |
| WO | WO 86 07603 | | 12/1986 |
| WO | 95/33035 | * | 12/1995 |
| WO | WO 96 04244 | | 2/1996 |

* cited by examiner

*Primary Examiner*—Charles Boyer
(74) *Attorney, Agent, or Firm*—Oblon, Spivak, McClelland, Maier & Neustadt, P.C.

(57) ABSTRACT

Use of amines as bleaching efficiency boosters for textile detergent compositions, where the $pK_a$ of the amines is greater than the pH minus 1, preferably greater than the pH, particularly preferably at least 0.5 greater than the pH of the 1% by weight wash liquor obtained from the textile detergent composition.

2 Claims, No Drawings

BLEACHING EFFICIENCY BOOSTERS FOR BLEACH AND TEXTILE DETERGENT COMPOSITIONS

This application is a Continuation-in-part (CIP) of application Ser. No. 09/155,354 filed on Sep. 28, 1998, now U.S. Pat. No. 6,130,198, which was originally filed as International Application No. PCT/EP97/01513, filed Mar. 25, 1997.

The invention relates to the use of amines as bleaching efficiency boosters for textile detergent compositions and to bleach and textile detergent compositions containing these.

It is known that the bleaching effect of peroxy compounds, peracids and combinations of peroxy compounds with peracid-liberating activators used as bleaches can be enhanced by adding bleaching efficiency boosters or bleach catalysts. Examples of metal-free bleach catalysts employed are iminium salts, sulfone imines and N-sulfonyloxaziridines.

EP-B1-0 313 146 gives a general description of the use of secondary amines of the formula $$(C_{6-20}\text{-hydrocarbyl})(C_{1-20}\text{-hydrocarbyl})NH$$

in amounts of 1–10% by weight as additional softening agent in detergent compositions which contain a bleach and a bleach activator.

EP-A3-0 236 270 gives a general description of aliphatic secondary amines in amounts of 1–10% by weight as foam generators or surface-active compounds in conjunction with a specific bleach and bleach activators in speckles.

JP-A-07197097 describes bleach compositions which contain a peroxide of the oxygen type, a bleach activator based on acyloxyanilide derivatives and one or more amines, amine salts or quaternary ammonium salts in an amount of at least 1% by weight. In this case, the amines can be the hydrophilic secondary amines diethanolamine, ethanolmethylamine, diisopropanolamine or N-methylaniline.

The compositions are used for bleaching dyed textiles, the intention being to avoid loss of color from the dyeing.

JP06248295 describes bleach compositions which have a long shelf life and high bleaching efficiency and avoid loss of color from textiles. The compositions contain peroxides and a salt consisting of a bleach activator and an aromatic peracid precursor anion and a quaternary ammonium ion in an amount of at least 0.7% by weight, which can be derived from the hydrophilic secondary amines diethanolamine, diisopropanolamine and dimethylamine.

EP-A-0 173 398 describes detergent compositions which are able to clean and soften textiles in a washing liquid. It is possible to use as essential textile softening ingredients a mixture of a long-chain secondary amine with cellulase. Dilaurylamine, distearylamine and tallow-methylamine are described as usable, in an amount of from 0.5 to 15% by weight, preferably 1 to 10% by weight, particularly preferably 2 to 5% by weight. The detergent compositions may contain bleaches and bleach activators.

DD 129 565 describes detergent compositions which contain antiredeposition agents. It is possible to use as antiredeposition agent ricinoleic acid ethanolamide in an amount of 5 parts by weight, in conjunction with sodium borate perhydrate. Also described as suitable are dodecylethanolamine, hexadecylethanolamine and oleic acid ethanolamide in an amount of from 1 to 5 parts by weight.

WO 86/07603 describes detergents for low washing temperatures which contain as detergency-boosting additive an aliphatic amine compound. The amnido amines listed may be secondary amines, but only tertiary amines are used in the described detergents, in amounts of more than 1% by weight, with or without the presence of bleaches and bleach activators.

EP-A-0 315 204 describes cyclic secondary amines as quenchers for singlet oxygen. They are employed in a bleach, in addition to a compound containing active halogen, in an amount of from 0.5 to 40% by weight, preferably 2.0 to 30% by weight. A bleach detergent composition may contain from 0.1 to 30% by weight of the cyclic hindered secondary amine, with the amount in the exemplary formulations being at least 5 parts by weight.

EP-A3-0 349 153 describes aromatic secondary amines as radical scavengers for free radicals in liquid hydrogen peroxide compositions which contain no activator.

WO 95/33035 describes detergent compositions which contain oleoyl-sarcosinate and a surface-active amine. Preferably employed as surface-active amine are primary or tertiary amines. Secondary amines with two long-chain alkyl radicals are disclosed. The compositions are described as particularly effective for removing fatty or oily soilings.

EP-A1-0 026529 describes detergent compositions which also act as softeners. They may contain a cationic secondary amine. Examples indicated are coco-methylamine in an amount of 2% by weight and laurylbenzylamine.

It is an object of the present invention to provide a bleaching efficiency booster for bleach or textile detergent compositions.

It is another object of the present invention to provide a bleaching efficiency booster which is effective at low temperature.

It is another object of the present invention to provide a bleaching efficiency booster which is suitable for bleaching hydrophobic and/or hydrophilic soilings on textiles.

It is another object of the present invention to provide a bleach or textile detergent composition containing a bleach and a bleaching efficiency booster and having an improved bleaching effect.

It is another object of the present invention to provide a bleach or textile detergent composition which shows an improved bleaching effect at low temperature.

It is another object to provide a bleach or textile detergent composition which improves the removal of hydrophobic and/or hydrophilic soilings on textiles.

It is another object to provide a bleach or textile detergent composition which comprises a bleaching system and at least one enzyme, with the bleaching system adversely affecting the action of the enzyme only slightly or not at all.

We have found that these and other objects are achieved by using amines as bleaching efficiency boosters for textile detergent compositions, where the pKa of the amines is greater than the pH minus 1, preferably greater than the pH, particularly preferably at least 0.5 greater than the pH of the 1% by weight wash liquor obtained from the textile detergent composition, and by bleach or textile detergent compositions comprising these bleaching efficiency boosters.

We have found that the claimed amines enhance the bleaching effect of bleach compositions and textile detergent formulations. In particular, they enhance the bleaching effect of bleach or textile detergent compositions containing peroxy compounds or peracids, especially for hydrophobic/lipophilic stains on textiles and also for hydrophilic, lipophobic stains.

The bleaching efficiency-boosting effect with the claimed amines makes it possible to use the bleach or textile detergent compositions at low temperatures, in particular in the range up to a maximum of 40° C., at which bleach compositions often show inadequate effectiveness. The bleaching efficiency-boosting effect of the amines according to the invention may moreover be further increased by adding suitable bleach activators, with or without additional bleach-stabilizing additives.

The use of the amines according to the invention in the bleach or textile detergent compositions leads to only very little, or no, adverse effect on the action of enzymes which are likewise present, for example proteases. Known bleach systems generally have a marked adverse effect on the activity of enzymes.

There follow first a description of the amines which can be used according to the invention and then the other ingredients in the bleach compositions and textile detergent compositions according to the invention which contain bleaching efficiency boosters.

AMINES

The amines or oligo/polyamines used according to the invention as bleaching efficiency boosters have a $pK_a$ greater than the pH minus 1, preferably greater than the pH, particularly preferably at least 0.5 greater than the pH of the wash liquor obtained from 1% by weight of a textile detergent composition which contains the bleaching efficiency booster.

In this connection, the $pK_a$ means the value for the corresponding acid of the amine, i.e. of the protonated amine and is equal to 14-$pK_B$ of the amine.

In one embodiment of the invention, the amines used as bleaching efficiency boosters have a $pK_a$ above 10, preferably above 10.5, particularly preferably above 10.75. Particularly suitable amines have a $pK_a$ of from 10.9 to 11.5.

The pH of the wash liquor is, in one embodiment of the invention, from 8.5 to 12.0, preferably 9.0 to 11.5, particularly preferably 9.2 to 11.0, especially 9.5 to 10.5.

In one embodiment of the invention, the amines are aliphatic amines, that is to say the radicals different from hydrogen atoms are alkyl radicals or substituted radicals attached via alkylene radicals, for example aralkyl radicals. Examples of amines which can be used are the secondary amines listed below.

SECONDARY AMINES

In one embodiment according to the invention, use is made of low molecular weight, oligomeric or polymeric compounds which comprise secondary amino groups-$NHR^1$, in particular secondary amines of the general formula (I)

$$R^1NH\text{-}[(CR^3R^4)_m\text{-}NH]_n\text{-}R^2 \quad (I)$$

where n has an integral value from 0 to 20 and m has an integral value from 2 to 4, the radicals $R^3$ and $R^4$ are, independently, $C_{1-30}$-, preferably $C_{1-15}$-, hydrocarbyl radicals, and the radicals $R^1$ and $R^2$ are, independently, $C_{1-30}$-, preferably $C_{1-15}$-, hydrocarbyl radicals which may together form a cyclic radical, or salts thereof as bleaching efficiency boosters for textile detergent compositions.

In one embodiment of the invention, the secondary amine can be mono- or bis-α-branched. A bis-α-branched secondary amine can have the general formula (II)

$$R^4R^3HC\text{-}HN\text{-}CHR^1R^2 \quad (II)$$

where the radicals $R^1$, $R^2$, $R^3$ and $R^4$ have, independently of one another, the abovementioned meanings.

The term "hydrocarbyl" used in the description and the claims describes radicals which are based on hydrocarbons with the stated number of carbon atoms and which may be pure hydrocarbon radicals but may also have substituents. Examples of radicals embraced by the term "hydrocarbyl radicals" are indicated below.

The radicals $R^1$ and $R^2$ can, according to the invention, be $C_{1-30}$-alkyl radicals, preferably $C_{1-20}$-alkyl radicals, particularly preferably $C_{1-10}$-alkyl radicals, which can be straight-chain or branched. The radicals $R^1$ and $R^2$ can be $C_{2-30}$-alkenyl radicals, preferably $C_{2-20}$-, particularly preferably $C_{2-10}$, alkenyl radicals, which can be straight-chain or branched. The radicals may also be $C_{5-18}$-cycloalkyl radicals which may have branches, it being possible for a ring structure of five to eight carbon atoms to be formed. The radicals $R^1$ and $R^2$ may furthermore be $C_{7-18}$-aralkyl radicals in which an aromatic radical is bonded via an alkyl group to the amine nitrogen atom. The radicals may also be $C_{7-18}$-heteroalkyl radicals or $C_{6-18}$-aryl radicals or $C_{3-18}$-heteroaryl radicals, with, in the last-mentioned compounds, an aromatic radical being directly linked to the amine nitrogen atom.

The radicals $R^1$ and $R^2$ may furthermore carry one or more, preferably zero or one, substituents such as hydroxyl groups, $C_{1-4}$-alkoxy radicals, amino groups, $C_{1-4}$-alkylamino radicals, (di-$C_{1-4}$-alkyl)amino radicals, chlorine atoms, bromine atoms, nitro groups, cyano groups, $C_{1-4}$-alkylthio radicals, $C_{1-4}$-alkylsulfonyl radicals, carboxyl groups, sulfo groups, carboxy-$C_{1-4}$alkyl radicals, carbamoyl radicals or phenyl, tolyl or benzyl radicals.

The carbon chains in the radicals $R^1$ and $R^2$ may furthermore be interrupted by oxygen atoms, imino groups, $C_{1-4}$-alkylimino radicals, iminocarbonyl radicals, oxycarbonyl radicals or carbonyl radicals.

The radicals $R^1$ and $R^2$ may furthermore together form a cyclic radical so that, together with the amine nitrogen atom, they provide a cyclic structure. In this case, the ring of the cyclic radical is preferably formed from 3 to 13, preferably 5 to 9, in particular 6 to 8, carbon atoms which in turn can be substituted as described above. Preferred cyclic amines are azacyclohexane, azacycloheptane, azacyclooctane, azacyclononane, azacyclodecane, azacycloundecane and azacyclododecane, which may be substituted by $C_{1-8}$-alkyl radicals. It is also possible for other heteroatoms, such as oxygen or nitrogen atoms, to be present in the ring structure.

The aromatic, cycloaliphatic or heterocyclic radicals may, just like the aliphatic radicals, be substituted by the abovementioned radicals.

In a preferred embodiment, the radicals $R^1$ and $R^2$ are hydrophobic radicals. These radicals are preferably unbranched or branched $C_{1-30}$-alkyl radicals, preferably $C_{1-20}$-alkyl radicals, particularly preferably $C_{1-10}$-alkyl radicals, $C_{2-30}$-alkenyl radicals, preferably $C_{2-20}$-alkenyl radicals, particularly preferably $C_{2-10}$-alkeniyl radicals, $C_{5-18}$-cycloalkyl radicals, $C_{7-18}$-aralkyl radicals or $C_{7-18}$-heteroaralkyl radicals or $C_{6-18}$-aryl radicals or $C_{3-18}$-, preferably $C_{6-18}$-, heteroaryl radicals.

The secondary amines are preferably substituted non-symmetrically. The radicals $R^1$ and $R^2$ are then different from one another, it being possible for each of the radicals $R^1$ and $R^2$ to have one of the structures described above.

In this case, the radical $R^2$ is preferably an unbranched or branched $C_{1-6}$-alkyl radical, a $C_{2-6}$-alkenyl radical, a $C_{5-8}$-cycloalkyl radical, a $C_{7-9}$-aralkyl radical or $C_{7-9}$-heteroaralkyl radical or a $C_{1-6}$-aryl radical or $C_{3-6}$-heteroaryl radical.

The radical $R^1$ is preferably a $C_{6-14}$-hydrocarbyl radical which preferably has zero or one branch, and the radical $R^2$ is a $C_{1-5}$-hydrocarbyl radical, preferably a methyl radical, and n has the value zero. The radical $R^1$ can have, in particular, 7 to 11 carbon atoms.

It is possible in this case for the radicals $R^1$ and $R^2$ in one embodiment of the invention to be further substituted as described above.

Examples of preferred amines are N-hexyl-N-methylamine, N-heptyl-N-methylamine, N-octyl-N-methylamine, N-nonyl-N-methylamine, N-decyl-N-methylamine, N-dodecyl-N-methylamine, N-tridecyl-N-methylamine, N-tetra-decyl-N-methylamine, N-benzyl-N-methylamine, N-phenylethyl-N-methylamine, N-phenylpropyl-N-methylamine, each of which may have linear or branched hydrocarbon radicals, and the corresponding N-alkyl-N-ethylamines, N-alkyl-N-hydroxyethylamines, N-alkyl-N-propylamines, N-alkyl-N-hydroxypropylamines, N-alkyl-N-isopropylamines, N-alkyl-N-butylamines and N-alkyl-N-isobutylamines and corresponding N-alkyl-N-hydroxyalkylamines in which the methyl radical is replaced by an ethyl, propyl, isopropyl, butyl or isobutyl radical.

Cyclic, Bicyclic and Oligocyclic Amimes

As described above, the radicals $R^1$ and $R^2$ on the secondary nitrogen atom may form a cyclic structure. In one embodiment, the secondary amines are compounds of the general formula (III)

(III)

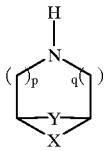

where p and q independently have an integral value from 0 to 4, preferably 0, 1 or 2, X is a $C_{1-8}$-, preferably $C_{1-4}$-alkylene radical which can be interrupted by O, S, —O—C(O)—, N—R or —NR—C(O)—, where R is a $C_{1-8}$; preferably $C_{1-4}$-alkyl radical, or X is a $C_{2-8}$-, preferably $C_{2-4}$-alkenylene radical, Y is a $C_{1-8}$-, preferably $C_{1-4}$-alkylene radical which can be interrupted by O, S, —O—C(O)—, —NR—C(O)—, or Y is a $C_{2-8}$, preferably $C_{2-4}$-alkenylene radical, O, S, —O—C(O)—, N—R or —NR—C(O)—, where R is H or a $C_{1-8}$-, preferably $C_{1-4}$-alkyl radical, or Y is a C—C single bond ("zero bridge").

X and Y may together form a C—C double bond if p+q has a value of at least 2. One or more hydrogen atoms bonded to carbon may be replaced by $C_{1-10}$-, preferably $C_{1-4}$-, in particular $C_1$-hydrocarbyl radicals. The bridgehead carbon atoms in particular may carry these hydrocarbyl radicals.

In one embodiment of the invention, two hydrogen atoms on adjacent ring carbon atoms at one or more places in the ring can be replaced by a C—C bond so that a C—C double bond is formed at this place.

In one embodiment of the invention, X and Y are independently $C_{1-8}$-alkylene radicals with in each case one carbon atom of X and Y being linked by a C—C single bond or via a $C_{1-8}$-, preferably $C_{1-4}$-, in particular $C_1$-alkylene radical or a $C_{2-8}$-, preferably $C_{2-4}$-alkenylene radical.

In one embodiment, X and Y are n-propylene radicals whose central carbon atoms are linked via a methylene group, in which case p=q=0.

X and Y can together form an aromatic ring, preferably an aromatic 6-membered ring, as long as p+q has a value of at least 2.

In one embodiment of the invention, p, q, X and Y are chosen so that each ring present in the molecule has at least 5 ring atoms.

In one embodiment of the invention, the secondary amines of the formula (III) have 5 to 20, preferably 6 to 14, particularly preferably 7 to 12, carbon atoms in the cyclic framework.

In one embodiment of the invention, one or more, preferably 1 to 5, in particular 1 to 3, hydrogen atoms bonded to carbon in the general formula (III) are replaced by $C_{1-10}$-, preferably $C_{1-4}$-, in particular $C_1$-hydrocarbyl radicals. These hydrogen atoms can also be replaced by $C_{1-10}$-, preferably $C_{1-4}$-, in particular $C_1$-alkyl radicals which may be straight-chain or branched, by $C_{1-10}$-, preferably $C_{1-4}$-, in particular $C_1$-alkoxy radicals, $C_{6-12}$-, preferably $C_{6-18}$-aryl radicals or $C_{6-12}$-, preferably $C_{6-8}$-aralkyl radicals. Particularly preferred substituents are methyl, ethyl, propyl, i-propyl, n-butyl, i-butyl and tert-butyl radicals, in particular methyl radicals.

In one embodiment of the invention, at least one ring in the general formula (III) is unsaturated. Moreover, in one embodiment of the invention, the total number of ring carbon atoms is 5 to 20, preferably 6 to 14, particularly preferably 7 to 12 carbon atoms.

In one embodiment of the invention, the amines of the formula (III) are benzo-fused amines with 5 to 20, preferably 6 to 14, particularly preferably 7 to 12, ring carbon atoms.

The secondary amines of the formula (III) are moreover cyclic, bicyclic or oligocyclic amines.

In one embodiment of the invention, p+q has the value 0 to 4, preferably 0 to 2, and X and Y have a total of 3 to 12, preferably 3 to 6, carbon atoms.

In one embodiment of the invention, p and q have the value 0, and each of the radicals X and Y is independently a $C_{2-6}$-, preferably $C_{2-4}$-alkylene radical. The total of the carbon atoms in the radicals X and Y is moreover preferably 4 to 6. At least one of the radicals X and Y can be an alkenylene radical, that is to say have a double bond.

In one embodiment of the invention, p+q has the value 2 to 6, preferably 2, 3 or 4, and the radicals X and Y together form an aromatic radical, preferably a benzene nucleus.

In one embodiment of the invention, p+q has the value 2 to 7, preferably 2, 3 or 4, and X and Y together form a C—C double bond.

In one embodiment of the invention, p has the value 0 and q has the value 1.

In one embodiment of the invention, p has the value 1 and q has the value 1.

In one embodiment of the invention, p has the value 0 and q has the value 1, the radical X is an oxygen or sulfur atom and the radical Y is a $C_{2-6}$-, preferably $C_{2-4}$-, in particular $C_{2-3}$-alkylene or -alkenylene radical which can be interrupted by O, S, —O—C(O)—, —NR—C(O)—, with the above meaning for R.

Examples of preferred compounds of the general formula (III) are evident from the table below.

| p | q | X | Y |
|---|---|---|---|
| 0 | 1 | Methylene | Propylene |
| 0 | 0 | Propylene | Propylene |
| 0 | 0 | Ethylene | Butylene |

-continued

| p | q | X | Y |
|---|---|---|---|
| 0 | 0 | Ethylene | Pentylene |
| 0 | 0 | Ethenylene | Butylene |
| 0 | 1 | Methylene | Ethylene |
| 0 | 1 | Methylene | Ethenylene |
| 0 | 1 | O | Ethenylene |
| 0 | 1 | S | Ethenylene |
| 0 | 0 | Ethylene | Ethenylene |
| 0 | 0 | Ethylene | Ethylene |
| 0 | 2 | Benzene nucleus | |
| 1 | 1 | C—C double bond | |
| 1 | 1 | Propylene | Zero bridge |
| 2 | 0 | Butylene | Zero bridge |
| 3 | 0 | Butylene | Zero bridge |
| 4 | 0 | Propylene | Zero bridge |

In one embodiment of the invention, the secondary amines have the general formula (IV).

(IV)

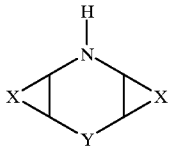

In this, X are independently $C_{1-8}$-, preferably $C_{3-4}$-alkylene radicals, $C_{2-8}$-, preferably $C_{3-4}$-alkenylene radicals or form an aromatic ring, in particular an aromatic $C_6$ ring (benzene ring).

Y is a $C_{1-8}$-, preferably $C_{1-4}$-, in particular $C_{1-2}$-alkylene radical, $C_{2-8}$-, preferably $C_{2-4}$-, in particular $C_2$-alkenylene radical, O, S or a C—C single bond.

X and Y may be interrupted as described for formula (III).

In a preferred embodiment, both X radicals form aromatic $C_6$ nuclei and Y is an oxygen atom, sulfur atom or a methylene radical.

One or more hydrogen atoms bonded to carbon may be replaced by substituents as detailed above for the compounds of the formula (III).

Further examples of preferred bicyclic secondary amines are azabicyclo[2.2.1]-heptanes, azabicyclo[2.2.2]octanes, azabicyclo[3.2.1]octanes, azabicyclo[3.3.0]-octanes, azabicyclo[3.2.2]nonanes, azabicyclo[3.3.1]nonanes, azabicyclo[4.2.1]-nonanes, azabicyclo[4.2.2]decanes, azabicyclo[4.3.1]decanes, it being possible for the nitrogen atom to be present at any position on the bridges, but not in the bridgehead position. The secondary amino group is thus located in the cyclic framework. 1,3,3-Trimethyl-6-azabicyclo[3.2.1]octane and 3-azabicyclo[3.2.2]-nonane are preferred.

In one embodiment of the invention, the total number of carbon atoms in the cyclic, bicyclic or oligocyclic secondary amine is 5 to 40, preferably 6 to 30, in particular 7 to 20 carbon atoms.

The cyclic, bicyclic or oligocyclic secondary amines according to the invention may have an even greater effectiveness as bleaching efficiency boosters than the acyclic amines.

In addition, when the secondary amines, in particular the cyclic, bicyclic or oligocyclic secondary amines, are used in enzyme-containing detergents with bleaching systems, the enzymatic action is not or only negligibly adversely affected, or is even improved, by the bleaching system. The single wash cycle performance for enzymatically removable stains is thereby significantly improved.

Preparation of the secondary amines used according to the invention is known. It can take place, for example, by reductive amination of aldehydes or by amination of nitrites. Cyclic amines can moreover be prepared by reducing the corresponding lactams and bicyclic amines by Diels-Alder reactions.

The preferably cyclic, bicyclic or oligocyclic secondary amine can be employed as free amine in detergent and cleaner formulations. It can also be in the form of the ammonium salt, in which case the anion is, for example, a tosylate, sulfate, chloride, bromide or an anion of an inorganic or organic acid.

The anion in this case should be stable to oxidation. Examples of suitable inorganic acids for forming the anion are sulfuric acid, phosphoric acid, polyphosphoric acid, boric acid and hydrochloric acid. Other suitable anions are silicates and alumosilicate anions. Examples of suitable organic acids are carboxylic acids, such as $C_{1-25}$-monocarboxylic acids, $C_{2-25}$-dicarboxylic acids, $C_{6-25}$-tricarboxylic acids, butanetetracarboxylic acid, polycarboxylic acids, such as polyacrylic acid, polymaleic acid, co- and terpolymers of acrylic acid and maleic acid with other monomers, sulfonic acids, such as $C_{1-25}$-allyl-, aralkyl- and arylsulfonic acids, phosphonic acids, such as $C_{1-25}$-alkyl-, aralkyl- and aryl-phosphonic acids, and $C_{1-25}$-aminophosphonic acids with 1 to 4 tertiary amino groups and 1 to 6 phosphonic acid groups. An example of a salt of secondary amine and a polycarboxylic acid is the salt of the amine with the acrylic acid/maleic acid copolymer Sokalan® CP 45 from BASF AG, it being possible to replace the $Na^+$ and $H^+$ cations normally present in the polycarboxylate by various amounts of the ammonium ion of the amine. Other examples of suitable anions are fatty acid anions and anions from citric acid or methylsulfonate.

The secondary amine is preferably employed in the form of a salt. In this case, the salts particularly preferably employed have the anions normally present in detergents or bleaches.

BLEACH OR TEXTILE DETERGENT COMPOSITION

Bleach

The secondary amines used according to the invention are used as bleaching efficiency boosters or bleach catalysts in bleach or textile detergent compositions which, in one embodiment of the invention, are based on active oxygen. These can be inorganic and/or organic peracids (percarboxylic acids) and/or peroxy compounds which, in combination with the, in particular secondary, amine according to the invention, show a stronger bleaching effect than without the combination with the amines, especially for lipophilic and/or lipophobic stains at low temperatures.

Examples are alkali metal perborates or alkali metal carbonate perhydrates, especially the sodium salts.

An example of an organic peracid which can be used is peracetic acid which is preferably used in commercial textile laundering or commercial cleaning.

Bleach or textile detergent compositions which can be advantageously used contain $C_{1-12}$-percarboxylic acids, $C_{8-16}$-dipercarboxylic acids, imidopercaproic acids or aryldipercaproic acids. Preferred examples of acids which can be used are peracetic acid, linear or branched monoperoctanoic, -nonanoic, -decanoic or -dodecanoic acids, diperdecane- and -dodecanedioic acids, mono- and diperphthalic acids, -isophthalic acids and -terephthalic acids, phthalimidoperca-proic acid (PAP) and terephthaloyldiamidopercaproic acid (TOCAP). It is likewise possible to use polymeric peracids, for example those containing acrylic acid basic building blocks in which a peroxy functionality is present. The percarboxylic acids can be used as free acids or as salts of the acids, preferably alkali metal or alkaline earth metal salts.

The bleach or textile detergent compositions are preferably employed for bleaching textiles, especially stained textiles, particularly preferably with hydrophobic or lipophilic stains such as chlorophyll from green plant parts (spinach, grass, leaves) or carotene from vegetables (carrots, tomatoes, paprika). In one embodiment, they are preferably used for bleaching lipophobic/hydrophilic stains, such as tea.

BLEACH ACTIVATOR

The bleaching efficiency boosting according to the invention due to use of the, in particular secondary, amines according to the invention is particularly effective on use in activated bleach or textile detergent compositions. In these cases, the secondary amine is employed in combination with a bleach activator and a peroxy compound which provides active oxygen. The bleaching effect achieved in this case exceeds that of an amine-free activated bleach composition, especially for lipophilic stains such as chlorophyll or carotene and/or lipophobic stains such as tea. The secondary amines employed according to the invention may be employed together with other suitable bleach catalysts. Examples thereof are quaternized imines and sulfone imines as described, for example, in U.S. Pat. No. 5,360,568, U.S. Pat. No. 5,360,569 and EP-A-0 453 003, as well as manganese complexes as described, for example, in WO-A 94/21777. Other metal-containing bleach catalysts which can be used are described in EP-A-0 458 397, EP-A-0 458 398 and EP-A-0 549 272.

Bleach activators which can be employed in one embodiment of the invention together with the, in particular secondary, amines according to the invention in bleach or textile detergent compositions are, for example, compounds of the following classes of substances:

Polyacylated sugars or sugar derivatives with $C_{1-10}$-acyl radicals, preferably acetyl, propionyl, octanoyl, nonanoyl or benzoyl radicals, particularly preferably acetyl radicals, can be used as bleach activators. Sugars or sugar derivatives which can be used are mono- or disaccharides and their reduced or oxidized derivatives, preferably glucose, mannose, fructose, sucrose, xylose or lactose. Particularly suitable bleach activators of this class of substances are, for example, pentaacetylglucose, xylose tetraacetate, 1-benzoyl-2,3,4,6-tetraacetylglucose and 1-octanoyl-2,3,4,6-tetraacetylglucose.

Another class of substances which can be used comprises acyloxybenzenesulfonic acids and their alkali metal and alkaline earth metal salts, it being possible to use $C_{1-14}$-acyl radicals. Acetyl, propionyl, octanoyl, nonanoyl and benzoyl radicals are preferred, especially acetyl radicals and nonanoyl radicals. Particularly suitable bleach activators in this class of substances are acetyloxybenzenesulfonic acid, benzoyloxybenzenesulfonic acid and nonanoyloxybenzenesulfonic acid (NOBS) or isononanoyloxybenzenesulfonic acid (isoNOBS). They are preferably employed in the form of their sodium salts.

It is furthermore possible to use O-acyloxime esters, such as acetone O-acetyloxime, acetone O-benzoyloxime, bis (propylimino) carbonate, bis(cyclohexylimino) carbonate. Acylated oximes which can be used according to the invention are described, for example, in EP-A-0 028 432. Oxime esters which can be used according to the invention are described, for example in EP-A-0 267 046.

It is likewise possible to use N-acylcaprolactams, such as N-acetylcaprolactarn, N-benzoylcaprolactam, N-octanoylcaprolactam and carbonylbiscaprolactam.

It is furthermore possible to use

N,N-diacylated and N,N,N',N'-tetraacylated amines, such as N,N,N',N'-tetraacetylmethylenediamine and -ethylenediamine (TAED), N,N-diacetylaniline, N,N-diacetyl-p-toluidine or 1,3-diacylated hydantoins such as 1,3-diacetyl-5,5-dimethylhydantoin;

N-alkyl-N-sulfonylcarboxamides, such as N-methyl-N-mesylacetamide or N-methyl-N-mesylbenzamide;

N-acylated cyclichydrazides, acylated triazoles or urazoles, such as monoacetylated maleic hydraiide;

O,N,N-trisubstituted hydroxylamines, such as O-benzoyl-N,N-succinyl-hydroxylamine, O-acetyl-N,N-succinylhydroxylamine or O,N,N-triacetyl-hydroxylamine;

N,N'-diacylsulfamides, such as N,N'-dimethyl-N,N'-diacetylsulfamide or N,N'-diethyl-N,N'-dipropionylsulfamide;

triacylcyanurates, such as triacetylcyanurate or tribenzoylcyanurate;

carboxylic anhydrides, such as benzoic anhydride, m-chlorobenzoic anhydride or phthalic anhydride;

1,3-diacyl-4,5-diacyloxyimidazolines, such as 1,3-diacetyl-4,5-diacetoxyimi-dazoline;

tetraacetylglycoluril and tetrapropionylglycoluril;

diacylated 2,5-diketopiperazines, such as 1,4-diacetyl-2,5-diketopiperazine;

acylation products of propylenediurea and 2,2-dimethylpropylenediurea, such as tetraacetylpropylenediurea;

α-acyloxypolyacyhnalonamides, such as α-acetoxy-N,N'-diacetylmalonamide;

diacyldioxohexahydro-1,3,5-triazines, such as 1,5-diacetyl-2,4-diox6hexa-hydro-1,3,5-triazine.

It is likewise possible to use 2-alkyl- or 2-aryl-(4H)-3,1-benzoxazin-4-ones as described, for example, in EP?-B1-0 332 294 and EP-B 0 502 013. It is possible to use in particular 2-phenyl-(4H)-3,1-benzoxazin-4-one and 2-methyl-(4H)-3,1-benzoxazin-4-one.

It is furthermore possible to use cationic nitriles, as described, for example, in EP 303 520 and EP 458 396 A1. Examples of suitable cationic nitriles are the methosulfates or tosylates of trimethylammonioacetonitrile, N,N-dimethyl-N-octylammonioacetonitrile, 2-(trimethylammonio)propionitrile, 2-(trimethylammonio)-2-methylpropionitrile. Also suitable are the methosulfates of N-methylpiperazinio-N,N'-diacetonitrile and N-methylmorpholinioacetonitrile (MMA).

The bleach activators which can be used according to the invention are preferably in the solid state of aggregation at room temperature because intimate contact of the amine with the bleach activator before use may be disadvantageous for achieving the optimal bleaching effect. Crystalline bleach activators which are particularly suitable according to the invention are tetraacetylethylenediamine (TAED), NOBS, isoNOBS, carbonylbiscaprolactam (CBC), benzoylcaprolactam, bis(2-propylimino) carbonate, bis (cyclohexylimino) carbonate, acetone O-benzoyloxime and 2-phenyl-(4H)-3,1-benzoxazin-4-one, anthranil, phenylanthranil, N-methylmorpholinoacetonitrile, N-octanoylcaprolactam (OCL) and N-methylpiperazine-N,N'-diacetonitrile, and liquid or poorly crystallizing bleach activators formulated as solid product. An example of a suitable formulation of such activators is given in the German Patent Application having the file reference 196 09 953.6, which is not a prior publication.

BLEACH STABILIZER

In one embodiment of the present invention, the bleach or textile detergent compositions which, for example, can be employed in detergents and cleaners additionally contain one or more bleach stabilizers. These comprise additives able to adsorb, bind or complex traces of heavy metals. Examples of additives which can be used according to the invention with a bleach-stabilizing action are polyanionic compounds, such as polyphosphates, polycarboxylates, polyhydroxypolycarboxylates, soluble silicates as completely or partially neutralized alkali metal or alkaline earth metal salts, in particular as neutral Na or Mg salts, which are relatively weak bleach stabilizers. Examples of strong bleach stabilizers which can be used according to the invention are complexing agents such as ethylenediaminetetraacetate (EDTA), nitrilotriacetic acid (NTA), methylglycinediacetic acid (MGDA), β-alaninediacetic acid (ADA), ethylenediamnine-N,N'-disuccinate (EDDS) and phosphonates such as ethylenediaminetetramethylenephosphonate, diethylenetriaminepentamethylenephosphonate or hydroxyethylidene-1, 1-diphosphonic acid in the form of the acids or as partially or completely neutralized alkali metal salts. The complexing agents are preferably employed in the form of their Na salts.

The detergents according to the invention preferably contain at least one bleach stabilizer, particularly preferably at least one of the abovementioned strong bleach stabilizers.

In one embodiment of the invention, the bleach or textile detergent compositions described may, in the area of textile laundering, of bleaching and of cleaning in the household and in the commercial sector, contain virtually all conventional ingredients of detergents, bleaches and cleaners. It is possible in this way to design, for example, compositions which are specifically suitable for textile treatment at low temperatures, and those which are suitable in several temperature ranges up to the traditional boiling wash range.

The main ingredients of textile detergents, bleaches and cleaners are, besides the bleach composition which consists of bleach and, in particular, secondary, amine according to the invention, with or without bleach activator, builders, that is to say inorganic builders and/or organic cobuilders, and surfactants, in particular anionic and/or nonionic surfactants. Besides these, it is also possible for other conventional auxiliaries and additives such as fillers, complexing agents, phosphonates, dyes, corrosion inhibitors, antiredeposition agents and/or soil release polymers, color transfer inhibitors, bleach catalysts, peroxide stabilizers, electrolytes, optical brighteners, enzymes, perfume oils, foam regulators and activating substances to be present in these compositions if this is expedient.

INORGANIC BUILDERS

Suitable inorganic builders are all conventional inorganic builders, such as alumbsilicates, silicates, carbonates and phosphates.

Examples of suitable inorganic builders are alumosilicates with ion-exchanging properties, such as zeolites. Various types of zeolites are suitable, expecially zeolites A, X, B, P, MAP and HS in their Na form, or in forms in which Na is partly replaced by other cations, such as Li, K, Ca, Mg or ammonium. Suitable zeolites are described, for example, in EP-A 038 591, EP-A 021 491, EP-A 087 035, U.S. Pat. No. 4 604 224, GB-A2 013 259, EP-A 522 726, EP-A 384 070 and WO 94/24 251.

Other suitable inorganic builders are, for example, amorphous or crystalline silicates, such as amorphous disilicates, crystalline disilicates such as the sheet silicate SKS-6 (manufactured by Hoechst). The silicates can be employed in the form of their alkali metal, alkaline earth metal or ammonium salts. Na, Li and Mg silicates are preferably employed.

ANIONIC SURFACTANTS

Suitable anionic surfactants are, for example, fatty alcohol sulfates of fatty alcohols with 8 to 22, preferably 10 to 18, carbon atoms, such as $C_9$–$C_{11}$-alcohol sulfates, $C_{12}$–$C_{13}$-alcohol sulfates, cetyl sulfate, myristyl sulfate, palmityl sulfate, stearyl sulfate and tallow fatty alcohol sulfate.

Other suitable anionic surfactants are sulfated ethoxylated $C_8$–$C_{22}$-alcohols (alkyl ether sulfates) and their soluble salts. Compounds of this type are prepared, for example, by firstly alkoxylating a $C_8$–$C_{22}$-, preferably a $C_{10}$–$C_{18}$-, alcohol, such as a fatty alcohol, and subsequently sulfating the alkoxylation product. Ethylene oxide is preferably used for the alkoxylation, employing 2 to 50, preferably 3 to 20 mol of ethylene oxide per mole of fatty alcohol. However, the alkoxylation of the alcohols can also take place with propylene oxide alone or together with butylene oxide. Also suitable are alkoxylated $C_8$–$C_{22}$-alcohols which contain ethylene oxide and propylene oxide or ethylene oxide and butylene oxide. The alkoxylated $C_8$–$C_{22}$-alcohols may contain the ethylene oxide, propylene oxide and butylene oxide units in the form of blocks or in random distribution.

Other suitable anionic surfactants are alkanesulfonates, such as $C_8$–$C_{24}$-, preferably $C_{10}$–$C_{18}$-, alkanesulfonates, and soaps, such as the salts of $C_8$–$C_{24}$-carboxylic acids.

Other suitable anionic surfactants are linear $C_9$–$C_{20}$-alkylbenzenesulfonates (LAS).

Other suitable anionic surfactants are N-acylsarcosinates with aliphatic saturated or unsaturated $C_8$–$C_{25}$-acyl radicals, preferably $C_{10}$–$C_{20}$-acyl radicals, for example N-oleoylsarcosinate.

The anionic surfactants are added to the detergent preferably in the form of salts. Suitable cations in these salts are alkali metal ions such as sodium, potassium and lithium, and ammonium ions, such as hydroxyethylammonium, di(hydroxyethyl)ammonium and tri(hydroxyethyl) ammonium ions.

NONIONIC SURFACTANTS

Examples of suitable nonionic surfactants are alkoxylated $C_8$–$C_{22}$-alcohols, such as fatty alcohol alkoxylates or oxoalcohol alkoxylates. The alkoxylation can be carried out with ethylene oxide, propylene oxide and/or butylene oxide. It is possible to employ as surfactant in this case all alkoxylated alcohols which contain at least two molecules of an abovementioned alkylene oxide in the adduct. Also suitable in this connection are block polymers of ethylene oxide, propylene oxide and/or butylene oxide, or adducts which contain said alkylene oxides in random distribution. From 2 to 50, preferably 3 to 20, mol of at least one alkylene oxide are used per mole of alcohol. Ethylene oxide is preferably employed as alkylene oxide. The alcohols preferably have 10 to 18 carbon atoms.

Another class of suitable nonionic surfactants comprises alkylphenol ethoxylates with $C_6$–$C_{14}$-alkyl chains and 5 to 30 mol of ethylene oxide units.

Another class of nonionic surfactants comprises alkyl polyglucosides with 8 to 22, preferably 10 to 18, carbon atoms in the alkyl chain. These compounds usually contain from 1 to 20, preferably 1.1 to 5, glucoside units.

Another class of nonionic surfactants comprises N-alkylglucamides of the general structure IV or V (IV)

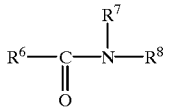

(V)

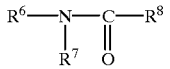

where $R^6$ is $C_6$–$C_{22}$-alkyl, $R^7$ is H or $C_1$–$C_4$-alkyl and $R^8$ is a polyhydroxyalkyl radical with 5 to 12 carbon atoms and at least 3 hydroxyl groups. $R^6$ is preferably $C_{10}$–$C_{18}$-alkyl, $R^7$ is preferably methyl and $R^8$ is preferably a $C_5$ or $C_6$ radical. Compounds of this type are obtained, for example, by acylation of reductively aminated sugars with the chlorides of $C_{10}$–$C_{18}$-carboxylic acids.

The detergents according to the invention preferably contain $C_{10}$–$C_{16}$ alcohols ethoxylated with 3–12 mol of ethylene oxide, particularly preferably ethoxylated fatty alcohols as nonionic surfactants.

ORGANIC COBUILDERS

Examples of low molecular weight pdlycarboxylates suitable as organic cobuilders are:

- $C_4$–$C_{20}$-di-, -tri- and -tetracarboxylic acids, such as succinic acid, propanetricarboxylic acid, butanetetracarboxylic acid, cyclopentanetetracarboxylic acid and alkyl- and alkenylsuccinic acids with $C_2$–$C_{16}$-alkyl- or -alkenyl radicals;
- $C_4$–$C_{20}$-hydroxy carboxylic acids, such as malic acid, tartaric acid, gluconic acid, glucaric acid, citric acid, lactobionic acid and sucrosemono-, -di- and -tricarboxylic acids;
- aminopolycarboxylates, such as nitrilotriacetic acid, methylglycinediacetic acid, alaninediacetic acid, ethylenediaminetetraacetic acid and serinediacetic acid;
- salts of phosphonic acids, such as hydroxyethanediphosphonic acid, ethylenediaminetetra (methylenephosphonate) and diethylenetriaminepenta-(methylenephosphonate).

Examples of oligomeric or polymeric polycarboxylates suitable as organic co-builders are:

- oligomaleic acids as described, for example, in EP-A-451 508 and EP-A-396 303;
- co- and terpolymers of unsaturated $C_4$–$C_8$-dicarboxylic acids, possible co-monomers which may be present being monoethylenically unsaturated monomers
  - from group (i) in amounts of up to 95% by weight
  - from group (ii) in amounts of up to 60% by weight
  - from group (iii) in amounts of up to 20% by weight.

Examples of unsaturated $C_4$–$C_8$-dicarboxylic acids suitable in this case are maleic acid, fumaric acid, itaconic acid and citraconic acid. Maleic acid is preferred.

The group (i) comprises monoethylenically unsaturated $C_3$–$C_8$-monocarboxylic acids, such as acrylic acid, methacrylic acid, crotonic acid and vinylacetic acid. Preferably employed from group (i) are acrylic acid and methacrylic acid.

Group (ii) comprises monoethylenically unsaturated $C_2$–$C_{22}$-olefins, vinyl alkyl ethers with $C_1$–$C_8$-alkyl groups, styrene, vinyl esters of $C_1$–$C_8$-carboxylic acids, (meth) acrylamide and vinylpyrrolidone. Preferably employed from group (ii) are $C_2$–$C_6$-olefins, vinyl alkyl ethers with $C_1$–$C_4$-alkyl groups, vinyl acetate and vinyl opropionate.

Group (iii) comprises (meth)acrylic esters of $C_1$–$C_8$-alcohols, (meth)acrylnitrile, (meth)acrylamides of $C_1$–$C_8$-amines, N-vinylformamide and vinylimidazole.

If the polymers contain vinyl esters as monomers of group (ii) these can also be partially or completely hydrolyzed to vinyl alcohol structural units. Suitable co- and terpolymers are disclosed, for example, in U.S. Pat. No. 3,887,806 and DE-A 43 13 909.

Copolymers of dicarboxylic acids which are suitable and preferred as organic cobuilders are the following:

- copolymers of maleic acid and acrylic acid in the ratio of 10:90 to 95:5 by weight,
- particularly preferably those in the ratio of from 30:70 to 90:10 by weight, with molecular weights of from 10,000 to 150,000;
- terpolymers of maleic acid, acrylic acid and a vinyl ester of a $C_1$–$C_3$-carboxylic acid in the ratio of from 10 (maleic acid): 90 (acrylic acid+vinyl ester) to 95 (maleic acid): 5 (acrylic acid+vinyl ester) by weight, it being possible for the ratio of acrylic acid to vinyl ester to vary in the range from 20:80 to 80:20 by weight, and particularly preferably
- terpolymers of maleic acid, acrylic acid and vinyl acetate or vinyl propionate in the ratio of from 20 (maleic acid): 80 (acrylic acid+vinyl ester) to 90 (maleic acid): 10 (acrylic acid+vinyl ester) by weight, it being possible for the ratio of acrylic acid to the vinyl ester to vary in the range from 30:70 to 70:30 by weight;
- copolymers of maleic acid with $C_2$–$C_8$-olefins in the molar ratio from 40:60 to 80:20, with copolymers of maleic acid with ethylene, propylene or isobutene in the molar ratio 50:50 being particularly preferred.

Graft polymers of unsaturated carboxylic acids on low molecular weight carbohydrates or hydrogenated carbohydrates, see U.S. Pat. No. 5,227,446, DE-A-44 15 623, DE-A-43 13 909, are likewise suitable as organic cobialders.

Suitable unsaturated carboxylic acids in this connection are, for example, maleic acid, fumaric acid, itaconic acid, citraconic acid, acrylic acid, methacrylic acid, crotonic acid and vinylacetic acid, and mixtures of acrylic acid and maleic acid, which are grafted on in amounts of from 40 to 95% of the weight of the component to be grafted.

It is additionally possible for up to 30% by weight, based on the component to be grafted, of other monoethylenically unsaturated monomers to be present for modification. Suitable modifying monomers are the abovementioned monomers of groups (ii) and (iii).

Suitable as grafting base are degraded polysaccharides, such as acidically or enzymatically degraded starches, inulins or cellulose, reduced hydrogenated or reductively aminated) degraded polysaccharides, such as mannitol, sorbitol, aminosorbitol and glucamine, and polyalkylene glycols with molecular weights of up to $M_w$=5,000 such as polyethylene glycols, ethylene oxidelpropylene oxide or ethyleneoxide/butylene oxide block copolymers, random ethylene, oxide/propylene oxide or ethylene oxide/butylene oxide copolymers, alkoxylated mono- or polyhydric $C_1$–$C_{22}$-alcohols, see U.S. Pat. No. 4,746,456.

Preferably employed from this group are grafted degraded or degraded reduced starches and grafted polyethylene oxides, employing from 20 to 80% by weight of monomers, based on the grafting component, in the graft polymerization. A mixture of maleic acid and acrylic acid in the ratio of from 90:10 to 10:90 by weight is preferably employed for the grafting.

Polyglyoxylic acids suitable as organic cobuilders are described, for example, in EP-B-001 004, U.S. Pat. No. 5,399,286, DE-A-41 06 355 and EP-A-656 914. The end groups of the polyglyoxylic acids may have various structures.

Polyamidocarboxylic acids and modified polyamidocarboxylic acids suitable as organic cobuilders are disclosed, for example, in EP-A-454 126, EP-B-511 037, WO 94/01486 and EP-A-581 452.

Also preferably used as organic cobuilders are polyaspartic acid or cocondensates of aspartic acid with other amino acids, $C_4$–$C_{25}$-mono- or -dicarboxylic acids and/or $C_4$–$C_{25}$-mono- or -diamines. Polyaspartic acids prepared in phosphorus-containing acids and modified with $C_6$–$C_{22}$-mono- or -dicarboxylic acids or with $C_6$–$C_{22}$-mono- or -diamines are particularly preferably employed.

Condensation products of citric acid with hydroxy carboxylic acids or polyhydroxy compounds which are suitable as organic cobuilders are disclosed, for example, in WO 93/22362 and WO 92/16493. Carboxyl-containing condensates of this type normally have molecular weights of up to 10,000, preferably up to 5,000.

ANTIREDEPOSITION AGENTS AND SOIL RELEASE POLYMERS

Suitable soil release polymers and/or antiredeposition agents for detergents are, for example:

- polyesters of polyethylene oxides with ethylene glycol and/or propylene glycol and aromatic dicarboxylic acids or aromatic and aliphatic dicarboxylic acids;
- polyesters of polyethylene oxides, which are endgroup-capped at one end, with di-and/or polyhydric alcohols and dicarboxylic acid.

Polyesters of this type are disclosed, for example, in U.S. Pat. No. 3,557,039, GB-A 1 154 730, EP-A-185 427, EP-A-241 984, EP-A-241 985, EP-A-272 033 and U.S. Pat. No. 5,142,020.

Other suitable soil release polymers are amphiphilic graft or other copolymers of vinyl and/or acrylic esters on polyalkylene oxides (see U.S. Pat. No. 4,746,456, U.S. Pat. No. 4,846,995, DE-A-37 11 299, U.S. Pat. No. 4,904,408, U.S. Pat. No. 4,846,994 and U.S. Pat. No. 4,849,126) or modified celluloses, such as methylcellulose, hydroxypropylcellulose or carboxymethylcellulose.

COLOR TRANSFER INHIBITORS

Color transfer inhibitors which are employed are, for example, homo- and copolymers of vinylpyrrolidone, of vinylimidazole, of vinyloxazolidone and of 4-vinylpyridine N-oxide with molecular weights of from 15,000 to 100,000, and crosslinked fine-particle polymers based on these monomers. The use of such polymers mentioned-herein is disclosed-in DE-B-22 32 353, DE-A-28 14 287, DE-A-28 14 329 and DE-A-43 16 023.

ENZYMES

In one embodiment of the invention, the bleach compositions containing at least one secondary amine are used in enzyme-containing detergents and cleaners. In many of these cases, the enzymes show an effect which enhances the action of the bleach composition and which is particularly marked on use of the bleach compositions according to the invention. Suitable enzymes in this connection are, for example, proteases, amylases, lipases and cellulases, especially proteases. It is possible to use several enzymes in combination.

On the other hand, the bleach compositions according to the invention containing at least one secondary amine adversely affect the action of the enzymes, in particular the single wash cycle performance, extremely slightly or not at all. Known bleach compositions by contrast often show an enzyme-damaging effect, which diminishes the effectiveness or activity of the enzymes. It is possible with the bleach compositions according to the invention to avoid this enzyme damage and achieve a high enzyme activity. This is particularly the case on use of cyclic, bicyclic or oligocyclic secondary amines.

Besides use in detergents and cleaners for household textile laundering, the bleach compositions which can be used according to the invention can also be employed in commercial textile laundering and commercial cleaning. For use in this sector, as a rule,peracetic acid is employed as bleach and is added as aqueous solution to the wash liquor. In this area of application, the secondary amine used according to the invention can either be added separately as single component in the washing or cleaning process, or be previously mixed together with other ingredients and then added as mixture.

USE IN TEXTILE DETERGENTS

Preferably the claimed amines are used in textile detergents compositions comprising at least one bleach and at least one bleach activator, which is preferably solid at room temperature, with or without a bleach stabilizer and with or without other bleach catalysts.

In one embodiment, the textile detergents comprising at least one, in particular secondary, amine according to the invention and based on peroxy compounds and percarboxylic acids comprise from 0.5 to 40% by weight, preferably 2.5 to 30% by weight, particularly preferably 5 to 25% by weight, of peroxy compounds or peracids, from 0 to 20% by weight, preferably from 0.1 to 20% by weight, preferably 0.5 to 10% by weight, particularly preferably 0.5 to 6.0% by weight, of bleach activators and from 0.01 to 5% by weight, preferably 0.05 to 2% by weight, particularly preferably 0.1 to 1% by weight, of at least one, in particular secondary, amine according to the invention.

In this case it is sufficient to incorporate catalytically active amounts of the secondary amine, as indicated above, in the bleach compositions. Even when such small amounts of secondary amines are used there is felt to be a strong enhancement of bleaching. On use of the secondary amines it is possible to improve considerably the efficiency of bleach compositions, especially cold bleach compositions and, in particular, with hydrophobic stains. The weaknesses of commercial bleach activators can thus be specifically compensated by using secondary amines, so that highly efficient bleaching is possible at low temperatures.

The amines to be used according to the invention are preferably employed in powder or granular detergents. These can be classic heavy duty detergents or concentrated or compact detergents.

A typical powder or granular heavy duty detergent according to the invention can have, for example, the following composition:

- 0.5–50% by weight, preferably 5–30% by weight, of at least one anionic and/or nonionic surfactant, 0.5–60% by weight, preferably 15–40% by weight, of at least one inorganic builder, 0–20% by weight, preferably 0.5–8% by weight, of at least one organic co-builder, 2–35% by weight, preferably 5–30% by weight, of an inorganic bleach, 0.1–20% by weight, preferably0.5–10% by weight, of a bleach activator, possibly mixed with other bleach activators, 0.005–2.5% by weight, preferably 0.1–1.0% by weight, of a described, in particular secondary, amine according to the invention, 0–1% by weight, preferably up to a maximum of 0.5% by weight, of a bleach catalyst, 0–5% by weight, preferably 0–2.5% by weight, of a polymeric color transfer inhibitor, 0–1.5% by weight, preferably 0.1–1.0% by weight, of protease, 0–1.5% by weight, preferably 0.1–1.0% by weight, of lipase, 0–1.5% by weight, preferably 0.2–1.0% by weight, of a soil release polymer, ad 100% conventional auxiliaries and additives and water.

Inorganic builders preferably employed in detergents are sodium carbonate, sodium bicarbonate, zeolites A and P, and amorphous and crystalline Na silicates.

Organic cobuilders preferably employed in detergents are acrylic acid/maleic acid copolymers, acrylic acid/maleic acid/vinyl ester terpolymers and citric acid.

Inorganic bleaches preferably employed in detergents are sodium perborate and sodium carbonate perhydrate.

Inorganic surfactants preferably employed in detergents are fatty alcohol sulfates, linear alkylbenzenesulfonates (LAS) and soaps, with the LAS content preferably being below 8% by weight, particularly preferably below 4% by weight.

Nonionic surfactants preferably employed in detergents are $C_{11}$–$C_{17}$-oxo alcohol ethoxylates with 3–13 ethylene oxide units, $C_{10}$–$C_{16}$-fatty alcohol ethoxylates with 3–13 ethylene oxide units, and ethoxylated fatty or oxo alcohols additionally alkoxylated with 1–4 propylene oxide or butylene oxide units.

Preferably the claimed amines are used in textile detergents compositions comprising at least one enzyme.

Enzymes preferably employed in detergents are protease, lipase and cellulase, the most preferred enzyme is protease. As a rule, the commercial enzyes are added to the detergent in amounts of from 0.05 to 2.0% by weight, preferably 0.2 to 1.5% by weight, of the formulated enzyme. Examples of suitable proteases are Savinase, Desazym and Esperase (manufactured by Novo Nordisk). An example of a suitable lipase is Lipolase (manufactured by Novo Nordisk). An example of a suitable cellulase is Celluzym (manufactured by Novo Nordisk).

Antiredeposition agents and soil release polymers preferably employed in detergents are graft polymers of vinyl acetate on polyethylene oxide of molecular weight 2,500–8,000 in the ratio of from 1.2:1 to 3.0:1 by weight, polyethylene terephthalates/oxyethylene terephthalates of molecular weight 3,000 to 25,000 from polyethylene oxides of molecular weight 750 to 5,000 with terephthalic acid and ethylene oxide and a molar ratio of polyethylene terephthalate to polyoxyethylene terephthalate of from 8:1 to 1:1, and block polycondensates as disclosed in DE-A-44 03 866.

Color transfer inhibitors preferably employed in detergents are soluble vinylpyrrolidone and vinylimidazole copolymers with molecular weights above 25,000, and fine-particle crosslinked polymers based on vinylimidazole.

The powder or granular detergents according to the invention may contain up to 60% by weight of inorganic fillers. Sodium sulfate is normally used for this purpose. However, the detergents according to the invention preferably have a low filler content of only up to 20% by weight, particularly only up to 8% by weight.

The detergents according to the invention may have apparent densities varying in the range from 300 to 1,200, in particular 500 to 950, g/l. Modem compact detergents have, as a rule, high apparent densities and a granular structure.

Besides combined detergents and bleaches, suitable formulations of the described bleach compositions for textile laundering are also compositions which are used as additives to peroxide-containing or peroxide-free detergents. They essentially contain the bleach composition consisting of bleach and secondary amine, with or without bleach activator, and, where appropriate, other auxiliaries and additives, especially stabilizers, pH regulators, thickeners and surfactants.

The present invention also relates to bleach additives in bleach or textile detergent compositions for textile laundering of the following composition:

5–50% by weight, preferably 15–35% by weight, of inorganic peroxy compound,

1–30% by weight, preferably 5–25% by weight, of bleach activators, 0.01–5.0, preferably 0.1–2.5,% by weight of a described amine, 0–5% by weight, preferably 0.1–3% by weight, of peroxide stabilizers, 0–40% by weight, preferably 5–30% by weight, of pH regulators, ad 100% by weight of other conventional auxiliaries and additives.

Examples of compositions of heavy duty detergents which can be used in the household are compiled in the following table.

In one embodiment of the invention, the bleach or textile detergent composition comprises (a) 0.5–40% by weight of bleach in the form of peroxy compounds and/or percarboxylic acids, (b) 0–20% by weight, preferably 0.1–20% by weight, of bleach activators, and (c) 0.1–1.0% by weight, preferably 0.25–0.60% by weight, in particular 0.25–0.45% by weight, of secondary amines according to formula (I), (III) or (IV) preferably according to formula (I), where n has the value 0, the radical $R^1$ is a $C_{6-14}$ hydrocarbyl radical or —hydroxyhydrocarbyl radical which preferably has zero to one branch, and the radical $R^2$ is a $C_{1-5}$-hydrocarbyl radical, preferably a methyl radical.

In one embodiment of the invention, the bleach or textile detergent composition comprises (a) 0.5–40% by weight of bleach in the form of peroxy compounds and/or percarboxylic acids, (b) 0.1–20% by weight of at least one bleach activator from the group of tetraacetylethylenediamine (TAED), NOBS, isoNOBS, carbonylbis-caprolac-tam, benzoylcaprolactam, bis(2-propylimino) carbonate, bis (cyclohexylimi-no) carbonate, acetone O-benzoyloxime, anthranil (2-methyl-(4H)-3,1-benzoxazin-4-one), phenylanthranil, N-methylmorpholinoacetonitrile, (2-phenyl-(4H)-3, 1

-benzoxazin-4-one), N-methylpiperazine-N,N'-diacetonitrile and N-octanoylcaprolactam (OCL) and (c) more than 0.1 to less than 1.0% by weight, preferably 0.15–0.95% by weight, of secondary amines according to formula (I), wherein preferably n has the value 0, the radical $R^1$ is a $C_{6-14}$-hydrocarbyl radical or —hydroxycarbyl radical which preferably has zero to one branch, and the radical $R^2$ is a $C_{1-5}$ -hydrocarbyl radical, preferably a methyl radical or according to formula (III) or (IV)

In one embodiment of the invention, the bleach or textile detergent composition comprises (a) 0.5–40% by weight of bleach in the form of peroxy compounds and/or percarboxylic acids, (b) 0–20% by weight, preferably 0.1–20% by weight, of bleach activators and (c) 0.01–5% by weight of secondary amines of the general formula $R^1R^2NH$ or of the corresponding ammonium salts, where the radical $R^1$ is an alkyl radical or a phenylalkyl radical with 7 to 12 carbon atoms, and the radical $R^2$ is $C_1$–$C_4$-alkyl, preferably 0.05–3% by weight of secondary amines from the group of N-heptyl-N-methylamine, N-octyl-N-methylamine, N-nonyl-N-methylanune, N-decyl-N-methylamine, N-2-propylheptyl-N-methylamine, N-ethylhexyl-N-methylamine, N-dodecyl-N-methyla mine, N-2-ethylhexyl-N-butylamine and N-2-phenylethyl-N-methylamine.

In one embodiment of the invention, the bleach or textile detergent composition comprises (a) 0.5–40% by weight of at least one bleach from the group of sodium perborates, sodium carbonate perhydrates, $C_1$–$C_{12}$-percarboxylic acids, $C_8$–$C_{16}$-dipercarboxylic acids, imidopercaproic acids and aryl-dipercaproic acids, (b) 0–20% by weight, preferably 0.1–20% by weight, of bleach activators and (c) more than 0.1 to less than 1.0% by weight, preferably 0.15–0.95% by weight, of secondary amines according to formula (I), wherein preferably n has the value 0, the radical $R^1$ is a $C_{6-14}$-hydrocarbyl radical or -hydroxycarbyl radical which preferably has zero to one branch, and the radical $R^1$ is a $C_{1-5}$-hydrocarbyl radical, preferably a methyl radical or according to formula (III) or (IV)

In one embodiment of the invention, the bleach or textile detergent composition comprises (a) 0.5–40% by weight of bleach in the form of peroxy compounds and/or percarboxylic acids, (b) 0–20% by weight, preferably 0.1–20% by weight, of bleach activators, and (c) 0.1 topless than 0.5% by weight, preferably 0.25–0.45% by weight, of secondary amines according to the invention.

In one embodiment of the invention, the bleach or textile detergent composition comprises (a) 0.5–40% by weight of bleach in the form of peroxy compounds and/or percarboxylic acids, (b) 0.1–20% by weight of at least one bleach activator from the group of tetraacetylethylenediamine (TAED), NOBS, isoNOBS, carbonylbis-caprolac-tam, benzoylcaprolactam, bis(2-propylimino) carbonate, bis (cyclohexylimi-no) carbonate, acetone O-benzoyloxime, anthranil (2-methyl-(4H)-3,1-benzoxazin-4-one, phenylanthranil (2-phenyl-(4H)-3,1-benzoxazin-4-one), N-methylmorpholinoacetoriitrile, N-methylpiperazine-N,N'-diacetonitrile and N-octanoylcaprolactam (OCL) and (c) more than 0.1 to less than 0.5% by weight, preferably 0.15–0.45% by weight, of secondary amines according to the invention.

In one embodiment of the invention, the bleach or textile detergent composition comprises (a) 0.5–40% by weight of at least one bleach from the group of sodium perborates, sodium carbonate perhydrates, $C_1$–$C_{12}$-percarboxylic acids, $C_8$–$C_{16}$-dipercarboxylic acids, imidopercaproic acids and aryl-dipercaproic acids, (b) 0–20% by weight, preferably 0.1–20% by weight, of bleach activators and (c) more than 0.1 to less than 0.5% by weight, preferably 0.15–0.45% by weight, of secondary amines according to the invention.

The invention additionally relates to a bleach or textile detergent composition comprising (a) 0.5–40% by weight of bleach in the form of peroxy compounds and/or percarboxylic acids, (b) 0–20% by weight, preferably 0.1–20% by weight, of bleach activators (c) 0.01–5, preferably 0.1–1, % by weight of secondary ammes according to the formulae (III) or (IV).

In one embodiment of the invention, the textile detergent composition is essentially phosphate-free.

In one embodiment of the invention, the textile detergent according to the invention is essentially free of linear alkylbenzenesulfonates and is preferably based on fatty alcohol sulfonates.

In one embodiment of the invention, the textile detergent composition according to the invention comprises at least one polycarboxylate, preferably in an amount of from 0.1 to 7.5% by weight.

The invention also relates to the use of a bleach or textile detergent composition for removing hydrophobic and/or hydrophilic stains on textiles.

TABLE 1

| | Compositions of heavy duty detergents | | | | | | |
|---|---|---|---|---|---|---|---|
| | I | II | III | IV | V | VI | VII |
| PVP (K value 30) | 1.5 | | | | | | |
| VI/VP copolymer (K value 30) | | 1.0 | | | | 0.6 | |
| VI/VP copolymer crosslinked | | | | | 1.0 | | 1.0 |
| AA/MA (M = 70,000) | | | 5.0 | | | | |

TABLE 1-continued

| Compositions of heavy duty detergents | I | II | III | IV | V | VI | VII |
|---|---|---|---|---|---|---|---|
| AA/MA (M = 10,000) | | | | | | | 5.0 |
| AA/MA/VAc terpolymer (M = 20,000) | | | | | | 5.0 | |
| Oligomaleic acid | | | | | 5.0 | | |
| Polyaspartic acid | 7.5 | | | | | | |
| Na perborate monohydrate | 15 | 15 | | | 15 | | 7.5 |
| Na percarbonate | | | 18 | 15 | | 18 | |
| TEAD | | | | 5.0 | | 4.2 | 2.0 |
| Carbonylbiscaprolactam | 4.0 | | 5.0 | | 2.9 | | |
| N-Octyl-N-methylamine | 0.25 | 0.3 | 0.5 | 0.5 | 0.3 | 0.6 | 0.15 |
| Na lauryl sulfate | | 6.0 | 12.0 | 6.0 | 5.5 | | |
| Linear alkylbenzenesulfonate Na salt | 3.1 | 1.7 | 0.8 | | | 6.5 | |
| Soap | 2.8 | 0.6 | 0.4 | 2.5 | 1.5 | | 2.4 |
| $C_{13}/C_{15}$ oxo alcohol * 3 EO | | 3.0 | | | | | |
| $C_{13}/C_{15}$ oxo alcohol * 7 EO | 4.7 | | 4.7 | 13.5 | 4.0 | 6.5 | |
| $C_{13}/C_{15}$ oxo alcohol * 10 EO | | 3.0 | | | | | |
| $C_{12}/C_{14}$-fatty alcohol * 7 EO | | | | | | | 10.0 |
| Lauryl alcohol * 13 EO | | | | | | 5.0 | |
| Zeolite A | 25 | 25 | 15 | | 30 | 15 | 35 |
| Zeolite P | | | | 40 | | | |
| SKS-6 | | | 14 | | | 15 | |
| Na disilicate | 2.5 | 3.9 | | 0.5 | 4.5 | | 1.5 |
| Mg silicate | 1.0 | | 0.8 | | 1.0 | 1.0 | 0.6 |
| Sodium sulfate | 20 | 2.5 | 3.2 | 2.0 | 1.5 | 5.5 | 3.4 |
| Sodium bicarbonate | | | 9.0 | 6.5 | | | |
| Sodium carbonate | 12.0 | 13.6 | | | 10.0 | 8.0 | 9.8 |
| Soil release polymer 1 | | 0.4 | | | 0.5 | | |
| Soil release polymer 2 | 1.0 | | | | 0.5 | 0.8 | 1.0 |
| Carboxymethylcellulose | 0.6 | 1.3 | 0.6 | 1.0 | 0.6 | 0.6 | 0.5 |
| Dequest 2046 ® | | | | 0.5 | | | |
| Citric acid | | 6.8 | 5.0 | | | 2.5 | 3.8 |
| Lipase | | | | | 1.0 | | |
| Protease | | 1.0 | | | 1.0 | 0.5 | 0.6 |
| Cellulase | | | | | | | 0.6 |
| Water | to 100 | to 100 | to 100 | to 100 | to 100 | to 100 | to 100 |

Soil release polymer 1 = Graft polymer of vinyl acetate on polyethylene glycol of molecular weight 6,000, molecular weight of the graft polymer 24,000
Soil release polymer 2 = Polyethylene terephthalate/polyoxyelhylene terephthalate of molecular weight 8,000
Dequest 2046 ® = Ethylenediamine-N,N,N',N'-tetra(methylenephosphonate)
SKS-6 = Commercial sheet silicate, manufactured by: Hoechst AG The invention is illustrated in detail by means of examples below.

Detergent compositions III and IV described above were used in the examples according to the invention. The washing processes were carried out in this case in a Launder-O-meter, Atlas standard type, under the following conditions:

TABLE 2

| Washing conditions | |
|---|---|
| Machine | Launder-O-meter |
| Cycles | 1 |
| Time | 30 min |
| Temperatures | 22° C., 38° C. and 60° C. |
| Water hardness | 3.0 mmol/l |
| Test fabric | 2.5 g test fabric with chlorophyll stain (WFK:CFT AS-4) plus 4 × 2.5 g cotton ballast fabric |
| Amount of liquor | 250 ml |
| Liquor ratio | 1:20 |
| Detergent | Nos. III and IV from Tab. 1 using the activator indicated in Tab. 3 and the percarboxylic acid indicated in Tab. 4, and using the amines indicated in Tabs. 3 and 4 in place of N-methyl-N-octylamine |
| Detergent concentration | 4.5 g/l |

The bleaching effect of the detergent composition was determined by measuring the color strength of the test fabric. This measurement took place by photometry. The color strengths of each of the test stains before and after washing were determined from the reflectance measurements on the individual test fabrics at 18 wavelengths in the range from 400 to 700 nm at 20 nm intervals by the method described in A. Kud, Seifen, Öle, Fette, Wachse 119, (1993) 590–594, and the absolute bleaching effect $A_{abs}$ was calculated therefrom in %. The absolute bleaching effect $A_{abs}$ is defined as follows:

$$Aabs = \frac{\text{Color strength (before washing)} - \text{Color strength (after Washing)}}{\text{Color strength (before washing)} - \text{Color strength (white fabric)}} 100\%$$

The amount of secondary amine used in the following examples was 0.5% by weight. Comparative tests were also carried out without use of a secondary amine and without use of a bleach activator and a secondary amine, and with use of amines not according to the invention (tests with nonylamine and N-octyl-N,N-dimethylamine).

The results of the tests for a number of secondary amines are compiled in Table 3 below:

TABLE 3

Results of washing tests with soiled test fabric
Numbers are the absolute bleaching effect $A_{abs}$ in %

| Sec. amine | Bleach activator | Detergent formulation | Chlorophyll 22° C. | 38° C. | 60° C. |
|---|---|---|---|---|---|
| N-Phenylethyl-N-methylamine | TAED | IV | 36.1 | 42.9 | 49.5 |
| N-Methyl-N-nonylamine | TAED | IV | 37.5 | 45.3 | 52.6 |
| *none | TAED | IV | 27.0 | 34.0 | 43.4 |
| *none | none | IV | 23.8 | 29.0 | 39.1 |
| N-Heptyl-N-methylamine | TAED | IV | 29.4 | 43.1 | 48.0 |
| *Nonylamine | TAED | IV | 21.9 | 30.6 | 40.9 |
| *N-Octyl-N,N-dimethylamine | TAED | IV | 21.9 | 34.2 | 44.0 |
| *none | TAED | IV | 25.1 | 33.8 | 41.8 |
| *none | none | IV | 23.8 | 32.5 | 38.9 |
| N-Hexyl-N-methylamine | TAED | IV | 30.9 | 44.4 | 50.7 |
| N-Octyl-N-methylamine | TAED | IV | 32.2 | 45.0 | 51.7 |
| N-Dodecyl-N-methylamine | TAED | IV | 32.6 | 42.4 | 49.0 |
| N-Ethylhexyl-N-butylamine | TAED | IV | 34.0 | 42.7 | 51.8 |
| *none | TAED | IV | 28.7 | 35.1 | 43.7 |
| *none | none | IV | 26.7 | 32.4 | 42.5 |
| N-Octyl-N-methylamine | OCL | III | 35.3 | 38.5 | 42.0 |
| *none | OCL | III | 29.2 | 35.8 | 40.5 |
| *none | none | III | 14.7 | 15.2 | 21.9 |
| N-Methyl-N-nonylamine | MMA | III | 32.5 | 34.2 | 41.9 |
| N-Methyl-N-nonylamine | TAED | III | 31.6 | 37.0 | 49.2 |
| *none | MMA | III | 28.6 | 32.6 | 38.9 |
| *none | TAED | III | 25.1 | 31.8 | 38.1 |
| *none | none | III | 22.9 | 27.3 | 35.6 |

*comparative tests

The results in Table 3 show that the bleaching effect of the bleach compositions used according to the invention, using secondary amines with percarbonate as oxygen-donating bleach and various bleach activators, on chlorophyll stains provides very good bleaching results which are distinctly superior to the bleaching effect of bleaches alone or a combination of bleach activator and bleach or a combination of bleach catalyst, bleach and amines not according to the invention.

In the tests below, percarboxylic acids were additionally employed as bleach, and no bleach activator was added. The results are compiled in Table 4.

TABLE 4

Results of washing tests with soiled test fabric
Numbers are the absolute bleaching effect $A_{abs}$ in %

| Sec. amine | Percarboxylic acid | Detergent formulation | Chlorophyll 22° C. | 38° C. | 60° C. |
|---|---|---|---|---|---|
| N-Methyl-N-nonylamine | PAP | IV | 45.4 | 49.3 | 55.6 |
| *none | PAP | IV | 34.3 | 41.3 | 46.5 |
| *none | none | IV | 27.9 | 31.6 | 44.3 |
| N-Phenylethyl-N-methylamine | TOCAP | IV | 33.9 | 39.2 | 47.5 |
| N-Methyl-N-nonylamine | TOCAP | IV | 35.0 | 42.1 | 48.8 |
| *none | TOCAP | IV | 28.6 | 35.4 | 43.5 |
| *none | none | IV | 23.8 | 29.0 | 39.1 |

*comparative tests

The results in Table 4 show that the bleaching effect on use of the secondary amine according to the invention in the bleach compositions provides considerably better bleaching results for chlorophyll stains than without use of the secondary amines or of the percarboxylic acid.

Washing tests were carried out with lipophilic or lipophobic contaminations of soiled test fabrics for a number of cyclic and bicyclic secondary amines. The stains used for this purpose were chlorophyll, tea and carotene. Formulation m was used as detergent formulation. The results are compiled in Tables 5 and 6 below.

TABLE 5

Results of washing tests at 38° C. with soiled test fabric; numbers are absolute bleaching effect $A_{abs}$ in %

| Sec. amine | Bleach activator | Detergent formulation | Chlorophyll | Tea | Carotene |
|---|---|---|---|---|---|
| Azacyclononane | TAED | III | 31.6 | 76.3 | 84.1 |
| Azacycloheptane | TAED | III | 32.7 | 76.8 | 83.3 |
| 3-Azabicyclo-3.3.2-nonane | TAED | III | 29.7 | 70.5 | 80.0 |
| *none | | III | 14.7 | 36.5 | 71.2 |
| *none | TAED | III | 18.4 | 69.2 | 71.8 |

*Comparative tests

TABLE 6

Results of washing tests at 30° C. with soiled test fabric; numbers are absolute bleaching effect $A_{abs}$ in %

| Sec. amine | Bleach activator | Detergent formulation | Chlorophyll | Tea | Carotene |
|---|---|---|---|---|---|
| Azacycloheptane | TAED | III | 32.1 | 69.6 | 64.9 |
| *none | none | III | 12.5 | 38.1 | 56.4 |
| *none | TAED | III | 15.0 | 64.1 | 55.4 |

*Comparative tests

The results in Tables 5 and 6 show that cyclic and bicyclic secondary amines show a great improvement in the bleaching effect on combination with bleach activators. This effect occurs both with hydrophobic stains such as chlorophyll and carotene and with hydrophilic stains such as tea.

In another series of tests, the cooperation of activated bleaching system consisting of bleach activator and secondary amine with enzymes was investigated. Protease was used as enzyme. The results of washing tests are compiled in Table 7 below.

TABLE 7

Results of washing tests on the action of protease in detergent with activated bleaching system at 20° C. with soiled test fabric WFK AS10 (blood/milk/ink); numbers are absolute bleaching effect $A_{abs}$ in %

| Activator | Amount of activator | Sec. amine | Amount of sec. amine | $A_{abs}$ [%] |
|---|---|---|---|---|
| TAED | 3.8% | Azacycloheptane | 0.5% | 90.4 |
| TAED | 3.8% | *— | | 88.8 |
| CBC | 3.8% | Azacycloheptane | 0.5% | 91.3 |
| CBC | 3.8% | *— | | 87.2% |

Comparative examples are indicated by * in the tables above.

The results in Table 7 show that the single wash cycle performance of the protease on the enzyme test fabric in the heavy duty detergent formulation with activated bleaching system is higher in the presence of secondary amines according to the invention than with formulations containing no secondary amine. The bleaching system thus has no adverse effect on the action of the enzyme in the detergent formulation but, on the contrary, intensifies its action.

The examples show that the use according to the invention of secondary amines as bleaching efficiency boosters leads to bleach compositions or detergent and cleaner compositions which show a considerably improved bleaching effect. The bleach compositions according to the invention can moreover be employed in a wide variety of areas of technical application, especially those in which a bleaching effect is to be achieved at a low temperature, preferably not exceeding 40° C. Successful bleaching can be achieved in particular with stains which are difficult to bleach, such as lipophilic compounds, for example chlorophyll spots (chlorophyll) or carotene-containing spots, and also for lipophobic stains, such as tea. Advantageous effects are achieved in particular in detergent formulations which comprise enzymes. Use of the secondary amines according to the invention as bleaching efficiency boosters makes it possible to increase distinctly the effectiveness of many bleach compositions.

We claim:

1. A bleach or textile detergent composition, comprising:

(a) 0.5–40% by weight of bleach in the form of peroxy compounds and/or percarboxylic acids, (b) 0.1–20% by weight of bleach activators and (c) 0.01–5% by weight of secondary amines of the general formula $R^1R^2NH$ or of the corresponding ammonium salts, wherein the radical $R^1$ is an alkyl radical or a phenylalkyl radical with 7 to 12 carbon atoms, and the radical $R^2$ is $C_1$–$C_4$-alkyl.

2. The bleach or textile detergent composition of claim 1, comprising 0.05–3% by weight of secondary amines or the corresponding ammonium salts selected from the group consisting of N-heptyl-N-methylamine, N-octyl-N-methylamine, N-nonyl-N-methylamine, N-decyl-N-methylamine, N-2-propylheptyl-N-methylamine, N-2-ethylhexyl-N-methylamine, N-dodecyl-N-methylamine, N-2-ethylhexyl-N-butylamine and N-2-phenylethyl-N-methylamine.

* * * * *